US006440184B2

(12) United States Patent
Noda et al.

(10) Patent No.: US 6,440,184 B2
(45) **Date of Patent: *Aug. 27, 2002**

(54) SMOKELESS CANDLE

(75) Inventors: Taizo Noda; Moriji Umeda; Daijiro Ohtani, all of Kanagawa (JP)

(73) Assignee: Cera Rica Noda Co., Ltd., Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/437,754

(22) Filed: Nov. 10, 1999

(30) Foreign Application Priority Data

Nov. 20, 1998 (JP) ..... 10-346655
Sep. 14, 1999 (JP) ..... 11-260957

(51) Int. Cl.[7] ..... C10L 5/00
(52) U.S. Cl. ..... 44/275; 431/288
(58) Field of Search ..... 44/275; 431/288

(56) References Cited

U.S. PATENT DOCUMENTS 3,630,697 A * 12/1971 Duling ..... 44/275
3,925,029 A * 12/1975 Wilson ..... 44/275
5,955,034 A * 9/1999 Zaunbrecher ..... 44/275
6,022,402 A * 2/2000 Stephenson et al. ..... 106/31.1
6,262,153 B1 * 7/2001 Webster et al. ..... 524/100

FOREIGN PATENT DOCUMENTS

JP 9-188893 7/1997

OTHER PUBLICATIONS

Chia, C. Y., The Chinese wax or insect wax industry in Szetschuan, (1940), China J. From:Chem. Zentr. II, p. 841.*

* cited by examiner

*Primary Examiner*—Cephia D. Toomer
(74) *Attorney, Agent, or Firm*—Rader, Fishman & Grauer, PLLC

(57) ABSTRACT

There is described a smokeless candle which contains insect or Chinese wax, in addition to paraffin wax, to prevent generation of soot, when burning flame of the candle flares.

5 Claims, No Drawings

SMOKELESS CANDLE

BACKGROUND OF THE INVENTION

1. Field of the Invention

The present invention relates to a candle, and more particularly a smokeless candle which generates no or almost no soot during burning thereof and which may contain a perfumery to release a fragrance during burning period of time.

2. Related Arts

Hitherto, bees wax and Japan wax had been used as raw material for preparing illuminating candles, but in the present time, a petroleum wax of paraffin wax and a mixture thereof with polyethylene wax or stearic acid have mainly been used.

Among candles, including Japenese type candles, on the market, there is a so-called "smokeless" candle, which shows perfect burning or combustion with no generation of soot under a windless condition. However, when a burning flame of the so-called "smokeless" candle on the market flares in the wind or the like, momentary generation of soot, even in a small amount, cannot be avoided.

Japenese Patent 9-188893 (A) discloses a so-called "aroma candle" for releasing a fragrance during burning. Said "aroma candle" is composed of a perfume precursor in a wax mixture of paraffin wax, as a main component, as well as polyethylene wax and higher fatty carboxylic acids, as additional components. The "aroma candle" generates the fragrance by decomposition of the perfume precursor when the candle burns. In recent years, various candles containing perfumery have been marketed for the purpose of aroma therapies because the light or burning flame of these candles has a soothing effect on human psyche.

The candle made of only paraffin wax or a candle containing paraffin wax as a main component burns near a state of perfect combuston with almost no soot generation, if the candle burns in a windless condition, but the candle has the following drawbacks.

(1) When the burning flame flares by the wind or the like, soot momentary generates to make worse environment in room, (2) The burning flame is somewhat long and thus there is some problem in safety and total burning period of time becomes shorter, (3) Somewhat strong inherent smell (offensive smell) generates, when the flame of candle is blown out, and (4) When a liquid perfumery is selected and amount thereof shall be set higher, hardness of the wax becomes low and thus configuration of a candle is limited to a stick type one, if the candle shall be manufactured by a molding process. This means that the wax should be poured into a glass or the like receptacle with various configuration for obtaining a candle with configuration other than stick type one, which candle product must be merchandised together with the receptacle.

SUMMARY OF THE INVENTION

A main object of the invention, therefore, is to provide a smokeless candle which contains paraffin wax as one of wax components thereof, wherein the generation of soot is remarkably inhibited or soot is not generated at all.

Another object of the invention is to provide a smokeless candle having a burning flame shorter than that in a conventional candle, so that the total burning period is longer than that of the conventional candle.

Other object of the invention is provide a smokeless candle which can be easily demolded, even if a liquid perfumery is composed into the wax component in somewhat large amount, whereby the candles with various configuration can be manufactured by utilizing a molding process known per se.

A still other object of the invention is to provide a smokeless candle having delicate light color tone with no irregular color tone to give transparent feeling, since some of marketed aroma candles have heavy color tone, although it seems to be that the paraffin wax has low affinity with various coloring matters, more particularly liquid type coloring matters and thus the coloring matter has been used in large amount to avoid generation of irregularity in color tone of the aroma candle.

According to the invention, the main object is attained by a smokeless candle comprising paraffin wax and an insect or Chinese wax, as wax components thereof.

Among the wax components for the smokeless candle according to the invention, the insect wax is that secreted by a secondary larva of *Ericerus pela* and adhered on a trunk and branches of *Fraxinus chinensis* and *Ligustrum lucidum*, which wax shows color tone near pure white by purification thereof and relatively high melting point of 80-83° C. The inventors have unexpectedly found the following facts regarding a candle which was prepared by composing the insect wax into paraffin wax to establish the invention.

(a) Generation of soot is remarkably restrained.

(b) Burning flame is short (about 1 cm which is a half of or more less than that of the candle made of paraffin wax) and thus the burning period of time becomes longer (the essential object of the invention lies in providing not an illuminating candle, but an aroma candle, so that the short burning flame is not a drawback but forms an advantage, in view of safety in use.

(c) The offensive smell inherent to the candle made of paraffin wax is not generated, when the flame of candle is blown out.

(d) Even if a liquid perfumery is composed by about 10% by weight to the wax components, the molten wax allows production of candles with good hardness through a molding process, whereby each of the candles generates fragrance with different intensity during burning thereof. The candle normally contains 3–10 g of perfumery per 100 g of wax.

(e) A molten mixture of the waxes shows good affinity with various liquid coloring agents, which allows production of candles having delicate light color tone with no irregularly colored portion to give transparent color feeling.

(f) A tip end of burning flame in a conventional candle points and almost continuously flares by ascending current due to burning of the candle but in case of the candle according to the invention, burning flame shows somewhat roundish tip and is stable as a whole to give a mild or restful feeling.

In the smokeless candle according to the invention, it is preferable that the wax components contain 5–60% by weight of the insect wax. Soot generation is remarkably reduced if the wax components contain about 5% by weight of the insect wax, so that, even if soot is momentarily generated due to flaring or swaying of the burning flame, the amount of soot generated is very slight, since the length of the burning flame is shorter than about 1 cm. In connection with this, please note that the length of the burning flame in commercially available aroma candles is 2 cm or more. If the wax components of the smokeless candle contain about 60% by weight or more of the insect wax, the wax mixture solidified in a mold is too hard, so a crack or breakage may occur at the time of demolding of the candle when the mold has a delicate or complete configuration; and the candle is not preferred based on its production cost.

Depending on the kind of perfumery, some perfumery may give an unpleasant odor, if its concentration in the aroma candle is too high. In the aforesaid Japanese Patent 9-188893(A), there is so described in paragraph No. 0007 that "as an amount of a perfume precursor in a candle, the precursor is composed so as to occupy to 0.01-20% by weight, more preferably 0.05-10% by weight, and further preferably 0.1-5% by weight, although it depends on the kind of perfumery", namely it is recommended to set the amount of perfumery in relatively low and in the Example, the amount of the precursor is only 1% by weight to wax components called as "burning materials". In case of the smokeless candle of the present invention, however, there is such a tendency that release of fragrance is suppressed, since the burning flame is shorter, and thus it is necessary to set an amount of the perfumery in somewhat higher level. In case of the conventional aroma candle made of paraffin wax or containing the paraffin wax as main wax component which contains no insect wax, a hardness thereof reduces, when a liquid perfumery is composed in a large amount, to cause the problem during demolding procedure. For manufacturing the candle of the invention, on the contrary thereto, the insect wax having relatively high melting point of 80–83° C. is used and, as a result, deformation of the smokeless candle does not occur in demolding. With the smokeless candle of the invention, the amount of melting and flowing wax formed during burning is small, so that there is little crumbling when the candle stops burning in a natural burning out. Namely, in case of the candle according to the invention, a shell portion of the candle remains in a state that substantially retains its original form. Please note that in case of the commercial aroma candle made of paraffin wax, the wax not burned remains in a state having no trace of its original form.

DETAILED DESCRIPTION OF PREFERRED EMBODIMENT

The invention will now be further explained with reference to Test Examples and Manufacturing Examples.

Followings are raw materials used in the Test Examples and Manufacturing Examples.

(1) Waxes (a) Paraffin Wax:

Commercially available purified product having melting point of 135° F.

(b) Insect wax:

Purified product sold by Cera Rica Noda Co., Ltd. of Kanagawa-ken, Japan.

(2) Coloring matters (a) Red coloring matter:

R-225 (Concentration in use; 0.3 mg/ml).

(b) Blue coloring matter:

B-403 (Concentration in use; 0.3 mg/ml).

(c) Green coloring matter:

G-202 (Concentration in use; 0.3 mg/ml).

(d) Yellow coloring matter:

Y-204 (Concentration in use; 0.1 mg/ml).

Please note that "R-225" and so on are symbols for identifying pigments.

TEST EXAMPLE 1

Soot Generation Test

Various candles having different ratio in composition of paraffin and insect waxes were prepared with use of a cylindrical mold so as to make demolding of the candle product easy. Each of the candles were lit to cause burning thereof under windless condition, a white paper was put near burning flame of the candle, and then flaring of the burning flame was forcedly caused by fanning the flame by a hand to check a frequency of soot generation through visual observation. Results are shown in following Table 1.

TABLE 1

| Raw material (% by weight) | | |
|---|---|---|
| Paraffin wax | Insect wax | Frequency of soot generation |
| 0 | 100 | ○○○○○ |
| 20 | 80 | ○○○○○ |
| 40 | 60 | ○○○○○ |
| 60 | 40 | ○○○○ |
| 80 | 20 | ○○○ |
| 83 | 17 | ○○ |
| 85 | 15 | ○○ |
| 88 | 12 | ○○ |
| 90 | 10 | ○○ |
| 93 | 7 | ○ |
| 95 | 5 | ○ |
| 97 | 3 | X |
| 100 | 0 | X |

In Table 1, ○○○○○: No soot generation was recognized in trials of more than 100 times, ○○○○: Soot generation was recognized by 1–2 times in trials of 100 times, ○○○: Soot generation was recognized by 1–2 times in trials of 50 times, ○○: Soot generation was recognized by 1–2 times in trials of 25 times, ○: Soot generation was recognized by 1–2 times in trials of 10 times, and X: Soot generation was recognizedin every or substantially every trials.

Consideration:

As apparently seen from the results shown in Table 1, the frequency of soot generation remarkably or sharply decreases by composing the insect wax into paraffin wax, when the candles are manufactured. The lower limit revealing the effect is less than 5% by weight and it seems to be that an practical upper limit thereof is about 60% by weight by taking and other factors into consideration. It has, further, been unexpectedly found a fact that in case of the candle consisting of paraffin wax only as its wax component, strong and offensive smell inherent to the wax generates, when burning flame is blown out but, in the candles prepared by composing the insect wax to the paraffin wax, such a smell does not generate or very weak.

TEST EXAMPLE 2

Demolding Ability and Hardness of Candle

Raw material waxes were taken in a ratio shown in Table 2 given later, put the same into a beaker and heated to melt by a water-bath. While, a cotton core for candles was dipped into molten paraffin wax, pulled out the same, and solidified the wax component to prepare a wax soaked cotton core which was attached to a pedestal. The pedestal is an aluminum disc with a small central opening, into which the wax soaked cotton core is passed to attach the same to the pedestal. The wax soaked cotton core with the pedestal was attached to a mold having a substantially semi-spherical configuration and having a small hole at a top portion thereof. In this case, the wax soaked cotton core was inserted into the hole of the mold, so that its free end somewhat projects from the hole for forming lightening portion of the candle to be prepared. Then, molten bees wax was adhered to the portion contacting the wax soaked cotton core and the opening of the hole in the mold and solidified the bees wax to fix the wax soaked cotton core with the pedestal to the mold.

After possibly added a rose perfumery to said molten wax mixture and stirred the resulting mixture, the mold was reversed and poured the molten wax into the reversed mold. In this case, pouring amount of the molten wax was set, so that surface level of the molten wax becomes somewhat higher than bottom surface of the pedestal. At the time when the surface of the molten wax poured into the mold caused solidification, the mold was transferred into a refrigerator (inside temperature: −5° C. ) to cool and cause complete solidification of the wax in the mold.

Thereafter, the mold was taken out from the refrigerator and the resulting candle was demolded to evaluate demolding ability thereof, namely as to that the candle can easily be demolded or not. Results are shown in Table 2 given later.

Further, penetration of the resulting candle samples was measured by a method described in JIS K-2235 to check hardness thereof. Results thereof are also shown in following Table 2.

TABLE 2

| Wax & perfume (% by weight) | | | Demolding | |
|---|---|---|---|---|
| Paraffin | Insect | Perfumery | ability | Penetration (25° C.) |
| 40 | 60 | 0 | ○ | 8.8 |
| 40 | 60 | 6 | ○ | 11.6 |
| 40 | 60 | 10 | ○ | 12.8 |
| 100 | 0 | 0 | Δ | 12.1 |
| Marketed product A | | | Δ | 18.8 |
| Marketed product B | | | X | 31.0 |

In Table 2, ○: Demolding is easy, Δ: Demolding is somewhat difficult, and X: Candle cannot be draw out from mold.

Consideration or Evaluation:

The wax mixture prepared by composing the insect wax has a low penetration and sufficient hardness to allow easy molding operation and subsequent drawing or pulling out operation to obtain the desired candle product, even if a liquid perfumery is composed in amount of 10% by weight to the wax components. The demolding ability of the wax containing the insect wax is excellent than the paraffin wax and the wax composition in commercially available aroma candles.

Further, It has been confirmed through other tests that if an aroma candle should be prepared by using the paraffin wax solely, composing a liquid perfumery, and by utilizing a molding process, an amount of the perfumery is limited to about 5-6% by weight to the paraffin wax and otherwise, hardness of the wax becomes too low to cause deformation in the candle to be formed or a part of the wax remains on inner surface of the mold and in any event, a desired aroma candle product cannot be obtained. It means that the paraffin wax containing the liquid perfumery in large amount is not suitable for manufacturing the aroma candle by molding process and thus it should be poured into a glass or ceramic receptacle or bottle to merchandise the same together with the receptacle.

TEST EXAMPLE 3

Continuous Burning Test

Various candles different in composing ratio between paraffin wax and insect wax were prepared (weight of each candle sample: 20 g, configuration: semi-spheroid). Each of the candle was lit and continuously burned to observe time-lapsing change in configuration and measure total continuous burning period of time until its core is burned out (when the candle is naturally burned out, it is re-lit immediately). The composing ratio of the waxes and cumulative burning period of time are shown in following Table 3.

TABLE 3

| Raw material (% by weight) | | Cumulative burning |
|---|---|---|
| Paraffin wax | Insect wax | period of time (min.) |
| 0 | 100 | 260 |
| 20 | 80 | 240 |
| 40 | 60 | 230 |
| 60 | 40 | 190 |
| 80 | 20 | 170 |
| 100 | 0 | 160 |

Consideration:

The cumulative burning period of time becomes longer, as the candle contains the insect wax in larger amount. In case of the candle sample containing no insect wax, it presents a state remaining molten wax in small amount and has no trace of its original form, when the test was finished but, in the candle samples containing the insect wax, its shell portion shows a tendency of remaining without cause melting, and more particularly, in case of the candle sample containing no paraffin wax, shell portion substantially retains in its original form to present a configuration like as a bowl.

EXAMPLE 1

Paraffin wax (60 g) and insect wax (40 g) were taken, put the waxes in a beaker and heated to cause melting thereof by a water-bath. While, cotton core for candles was dipped into molten paraffin wax and then as in Test Example 2, prepare a wax soaked cotton core. The wax soaked cotton core was cut into several pieces, attach each of the core piece to a pedestal, and fixed the core piece with the pedestal to a stainless steel mold having a substantial semi-spherical configuration.

To the molten wax mixture, a rose perfumery (3 or 6 g) and red coloring matter (3.2 ml) or blue coloring matter (6.4 ml) were added to stir the same, and the resulting mixture was poured into each of the molds. The molds were transferred into a refrigerator to cause complete solidification of the wax in the molds and then demolded to obtain desired semi-spherical candles containing the rose perfumery (weight of each candle: 15 g).

Each of the candle has a delicate light pinky or blue color tone with no portion of irregular color tone to give transparent feeling.

EXAMPLE 2

The procedures described in Example 1 were repeated except that a lavender perfumery (3 or 6 g) and violet coloring matter (5.13 ml, prepared by mixing 2.37 ml of the red coloring matter with 2.76 ml of blue coloring matter but in case of using 3 g of the perfumery, no coloring matter was added) were selected, to prepare desired candles containing lavender perfumery. The resulting candles have pure white color tone or light purple color tone.

EXAMPLE 3

The procedures described in Example 1 were repeated except that rose or lavender perfumery (each 10 g) and green or yellow coloring matter (each 3.2 ml) were selected to prepare desired candles containing rose or lavender perfumery. The resulting candles have light greenish or yellowish color tone.

What is claimed is:

1. A smokeless candle comprising paraffin wax and insect wax derived from *Ericerus pela* as wax components thereof, which the insect wax occupies 5–60% by weight in the wax components.

2. A smokeless candle as claimed in claim 1, further comprising a perfumery in an amount of 3–10 g to 100 g of the wax component.

3. A smokeless candle as claimed in claim 1, further comprising a coloring matter.

4. A smokeless candle as claimed in claim 2, wherein said perfumery is a liquid one.

5. A smokeless candle as claimed in claim 3, wherein said coloring matter is a liquid one.

* * * * *